US011043165B2

(12) United States Patent
Li

(10) Patent No.: US 11,043,165 B2
(45) Date of Patent: Jun. 22, 2021

(54) ACTIVE-MATRIX ORGANIC LIGHT EMITTING DIODE (AMOLED) PANEL CELL TESTING CIRCUIT AND METHOD FOR REPAIRING DATA LINES VIA SAME

(71) Applicant: WUHAN CHINA STAR OPTOELECTRONICS SEMICONDUCTOR DISPLAY TECHNOLOGY CO., LTD., Hubei (CN)

(72) Inventor: Chao Li, Hubei (CN)

(73) Assignee: WUHAN CHINA STAR OPTOELECTRONICS SEMICONDUCTOR DISPLAY TECHNOLOGY CO., LTD., Hubei (CN)

( * ) Notice: Subject to any disclaimer, the term of this patent is extended or adjusted under 35 U.S.C. 154(b) by 0 days.

(21) Appl. No.: 16/631,182

(22) PCT Filed: May 20, 2019

(86) PCT No.: PCT/CN2019/087625

§ 371 (c)(1),
(2) Date: Jan. 15, 2020

(87) PCT Pub. No.: WO2020/220408

PCT Pub. Date: Nov. 5, 2020

(65) Prior Publication Data

US 2020/0342807 A1 Oct. 29, 2020

(30) Foreign Application Priority Data

Apr. 29, 2019 (CN) ..... 201910357024.5

(51) Int. Cl.
*G09G 3/32* (2016.01)
*G09G 3/3233* (2016.01)

(52) U.S. Cl.
CPC ..... *G09G 3/3233* (2013.01)

(58) Field of Classification Search
CPC ..... G09G 2300/0426; G09G 2330/08; G09G 3/006; G09G 3/3225; G09G 3/3233
USPC ..... 345/76
See application file for complete search history.

(56) References Cited

U.S. PATENT DOCUMENTS 8,614,591 B2 * 12/2013 Kim ..... G09G 3/006 324/762.07
2010/0277400 A1 * 11/2010 Jeong ..... G09G 3/3275 345/76
2014/0354285 A1 * 12/2014 Kim ..... G09G 3/3233 324/414
2017/0046992 A1 * 2/2017 Zhou ..... G01R 31/44

* cited by examiner

*Primary Examiner* — Tony O Davis
(74) *Attorney, Agent, or Firm* — Mark M. Friedman

(57) ABSTRACT

The application relates to an active-matrix organic light emitting diode (AMOLED) panel cell testing circuit and a method for repairing data lines via the AMOLED panel cell testing circuit. The application not only can achieve a screen detecting function of the cell testing circuit, but also achieve to repair the circuit and to improve panel yield.

12 Claims, 7 Drawing Sheets

ACTIVE-MATRIX ORGANIC LIGHT EMITTING DIODE (AMOLED) PANEL CELL TESTING CIRCUIT AND METHOD FOR REPAIRING DATA LINES VIA SAME

CROSS REFERENCE TO RELATED APPLICATION

This application claims the priority of International Application No. PCT/CN2019/087625 filed on 2019 May 20, which claims priority to Chinese Application No. 201910357024.5, filed on 2019 Apr. 29. The entire disclosures of each of the above applications are incorporated herein by reference.

BACKGROUND OF INVENTION

Field of Invention

The present invention relates to a display field, and particularly to an active-matrix organic light emitting diode (AMOLED) panel cell testing circuit and a method for repairing data lines via the AMOLED panel cell testing circuit.

Description of Prior Art

Active-matrix organic light emitting diode (AMOLED) panels have self-luminous properties and are made of a very thin organic material coating layer and a glass substrate. When an electric current passes, light is emitted from the organic materials. The AMOLED panels are self-illuminating, unlike thin film field effect transistor liquid crystal display (TFT LCD) panels with backlights, have wide viewing angles, high color saturation, especially low driving voltage and low power consumption, fast response times, light weight, thin thickness, simple construction, low cost, and etc., and is regarded as one of the most promising products.

At present, product yield is still a key issue of AMOLED technology. For monitoring different process yields, detection circuits are placed in the panels for screening normal panels during the different processes, thereby to decrease defective products flowing into the latter process stages. Cell testing circuit is a common detection circuit and is configured for detect panels in a cell process.

In a typical AMOLED panel, the cell testing circuit can only be used as a circuit for detecting the panel display. Referring to FIG. 1, it is a schematic diagram of a conventional cell testing circuit, which uses more traces and is placed in a larger space, which is disadvantageous to a narrow bezel design of a panel, and mainly includes six thin film transistors T1 to T6 as switches, gates of T1-T6 are respectively connected with three detection control signals EN-G, EN-R/B, and EN-B/R as switching signals, input terminals of T1-T6 are respectively input signals Data R/B, Data G, and Data B/R as detected data, output terminals of T1-T6 are connected to detection data signal lines CT-G, CT-B/R, and CT-R/B respectively, which is connected to signal lines of active display area of the panel by the testing data signal lines to achieve a cell testing process by input data signal Data R/B, Data G, and Data B/R respectively.

When the data line in the panel fails, the panel screen displays an abnormality (a vertical bright line appears), and the existing box detecting circuit shown in FIG. 1 is only used as a screen detecting circuit.

SUMMARY OF INVENTION

A purpose of the application is that for providing an AMOLED panel cell testing circuit and a method for repairing data lines via the AMOLED panel cell testing circuit of to overcome a defect of a conventional cell testing circuit just used as a screen detecting circuit.

In order to achieve the above purposes, the application provides an active-matrix organic light emitting diode (AMOLED) panel cell testing circuit, including:

a first switch, wherein a control end of the first switch is connected to a detection control signal, a first data signal is input into an input end of the first switch, an output end of the first switch is connected to a first detection data signal line;

a second switch, wherein a control end of the second switch is connected to a detection control signal, a second data signal is input into an input end of the second switch, an output end of the second switch is connected to a second detection data signal line;

a third switch, wherein a control end of the third switch is connected to a detection control signal, a third data signal is input into an input end of the third switch, an output end of the third switch is connected to a third detection data signal line;

wherein data lines of the panel are divided into first kind of data lines, second kind of data lines, and third kind of data lines according to an arrangement mode of a connection to sub pixels, the first detection data signal line is connected to the first kind of data lines, the second detection data signal line is connected to the second kind of data lines, and the third detection data signal line is connected to the third kind of data lines;

wherein the first detection data signal line, the second detection data signal line, and the third detection data signal line include a first vertical line, a second vertical line, and a third vertical line disposed correspondingly and placed in two sides of an active display area of the panel, and a plurality of first parallel lines, a plurality of second parallel lines, and a plurality of third parallel lines arranged by a default interval are formed in the active display area of the panel and correspondingly connected to the first vertical line, the second vertical line, and the third vertical line placed in the two sides.

The sub pixels connected to the first kind of data lines are arranged alternately by R sub pixels and B sub pixels; the sub pixels connected to the second kind of data lines are arranged alternately by B sub pixels and R sub pixels; and all of the sub pixels connected the third kind of data lines are G sub pixels.

When a cell testing process is employed, a solid color/or color bar screen detection process is employed by the first data signal, the second data signal, and the third data signal via a clock signal.

The cell testing circuit further is connected to cell testing pads, the cell testing pads are configured to provide the first data signal, the second data signal, and the third data signal for the cell testing circuit.

There are two cell testing pads placed in two sides under the active display area.

A main body is placed upon the active display area.

When an open circuit does not occur in the data lines of the panel, the first parallel lines, the second parallel lines, and the third parallel lines are not connected to the data lines.

When an open circuit occurs in a certain position of a certain data line of the panel, one of the first parallel lines, the second parallel lines, and the third parallel lines is connected to the certain data line to repair the open circuit in the certain position.

The application also provides a method for repairing the data lines via the AMOLED panel cell testing circuit of the above, including:

a step 10 of detecting an open circuit in a certain position of a certain data line in the active display area of the panel via the cell testing circuit;

a step 20 of selecting one selected position in each of two sides of the certain position of the certain data line, selecting one of the first parallel lines, the second parallel lines, and the third parallel lines to connect the certain data line at the selected positions to repair the open circuit in the certain position;

a step 30 of disconnecting the first data signal, the second data signal and the third data signal from the cell testing pads to the cell testing circuit in a module stage.

The method further includes a step 21 of repeating the step 10 and the step 20 to repair all of the open circuits of the certain data line.

The method further includes a step 22 of repeating the step 21 to repair several open circuits of several data lines in the active display area.

The first parallel line, the second parallel line, and the third parallel line are configured for repair the open circuits placed in three different data lines of the active display area of the panel respectively.

One of the first parallel line, the second parallel line, and the third parallel line is configured for repair the open circuits placed in different positions of one of the data lines of the active display area of the panel.

In conclusion, the AMOLED panel cell testing circuit and the method for repairing data lines via the AMOLED panel cell testing circuit not only can achieve a screen detecting function of the cell testing circuit, but also achieve to repair the circuit and to improve panel yield.

BRIEF DESCRIPTION OF DRAWINGS

The technical solutions and other beneficial effects of the present invention will be apparent from the following detailed description of embodiments of the invention.

Figure 1:
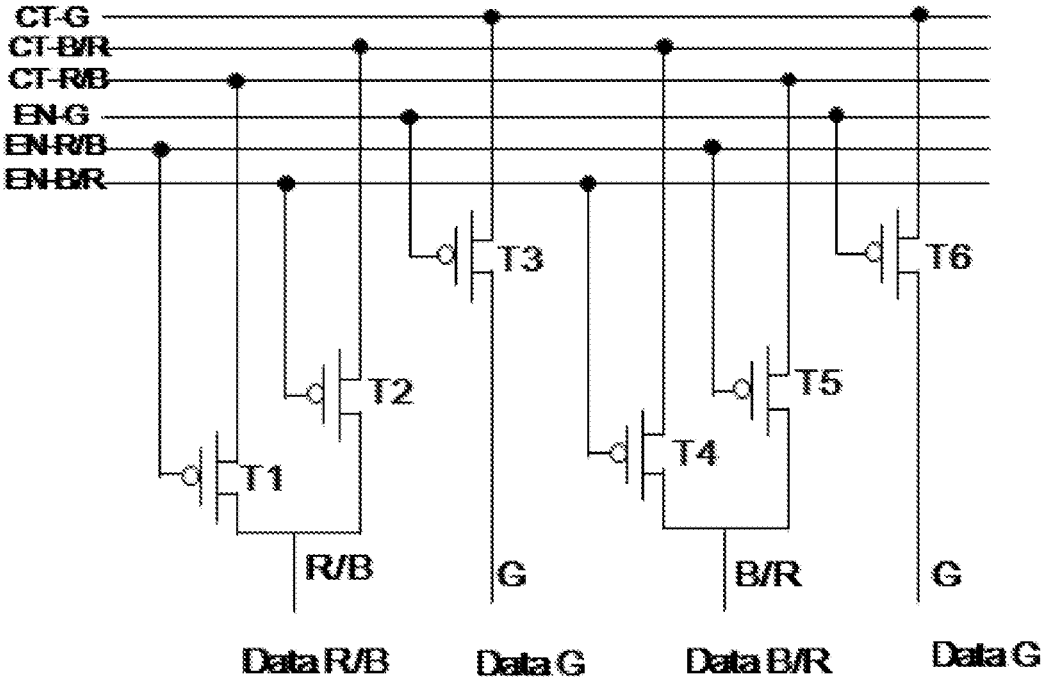

In FIGS.:

FIG. 1 is a schematic diagram of a cell testing circuit in prior art.

Figure 2A:
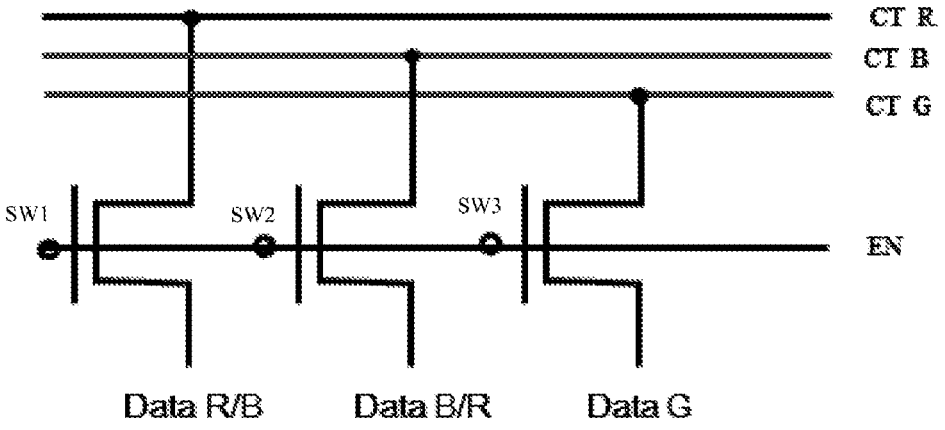

FIG. 2*a* is a schematic diagram of an AMOLED panel cell testing circuit of a preferred embodiment of the application.

Figure 2B:
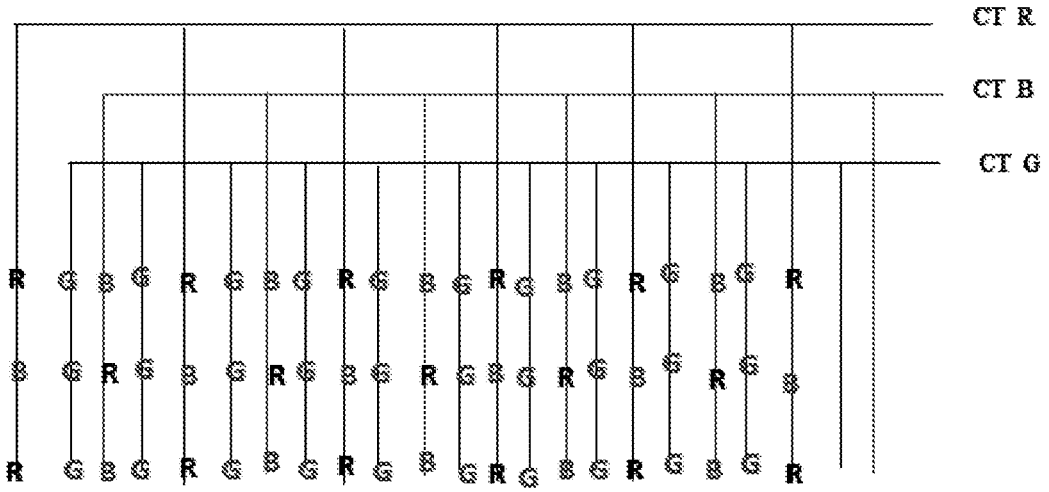

FIG. 2*b* is an equivalent circuit diagram of the AMOLED panel cell testing circuit of the preferred embodiment of the application.

Figure 3:
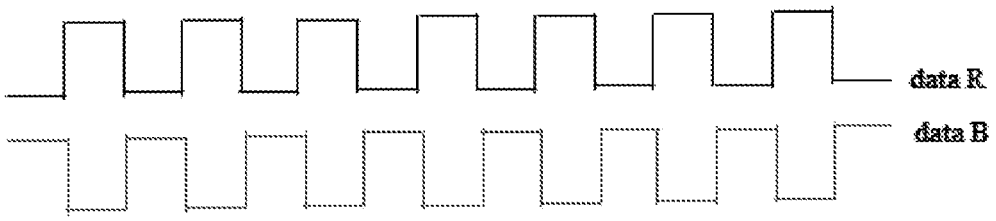

FIG. 3 is a clock signal diagram of the AMOLED panel cell testing circuit of the preferred embodiment of the application displaying a red screen.

Figure 4:
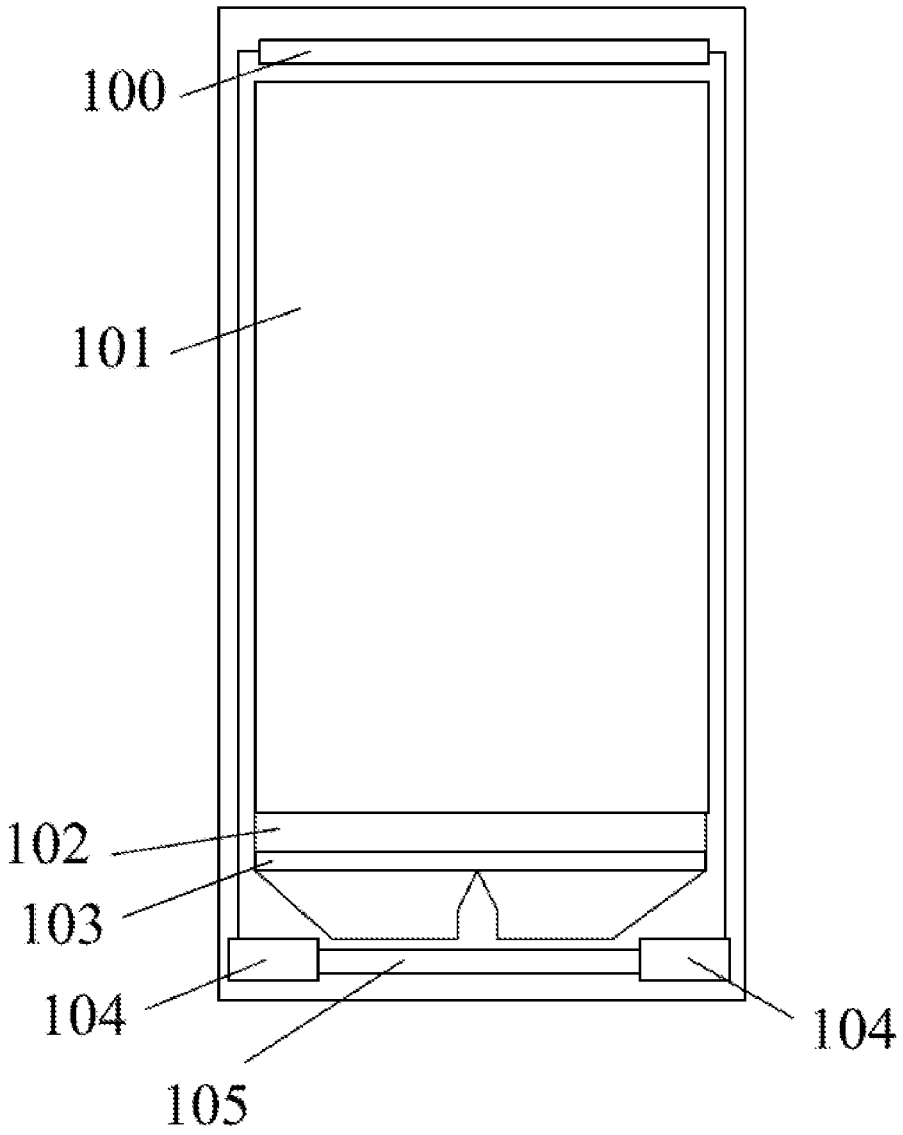

FIG. 4 is a diagram of positions of a cell testing circuit and a pad of the AMOLED panel cell testing circuit of the preferred embodiment of the application.

Figure 5A:
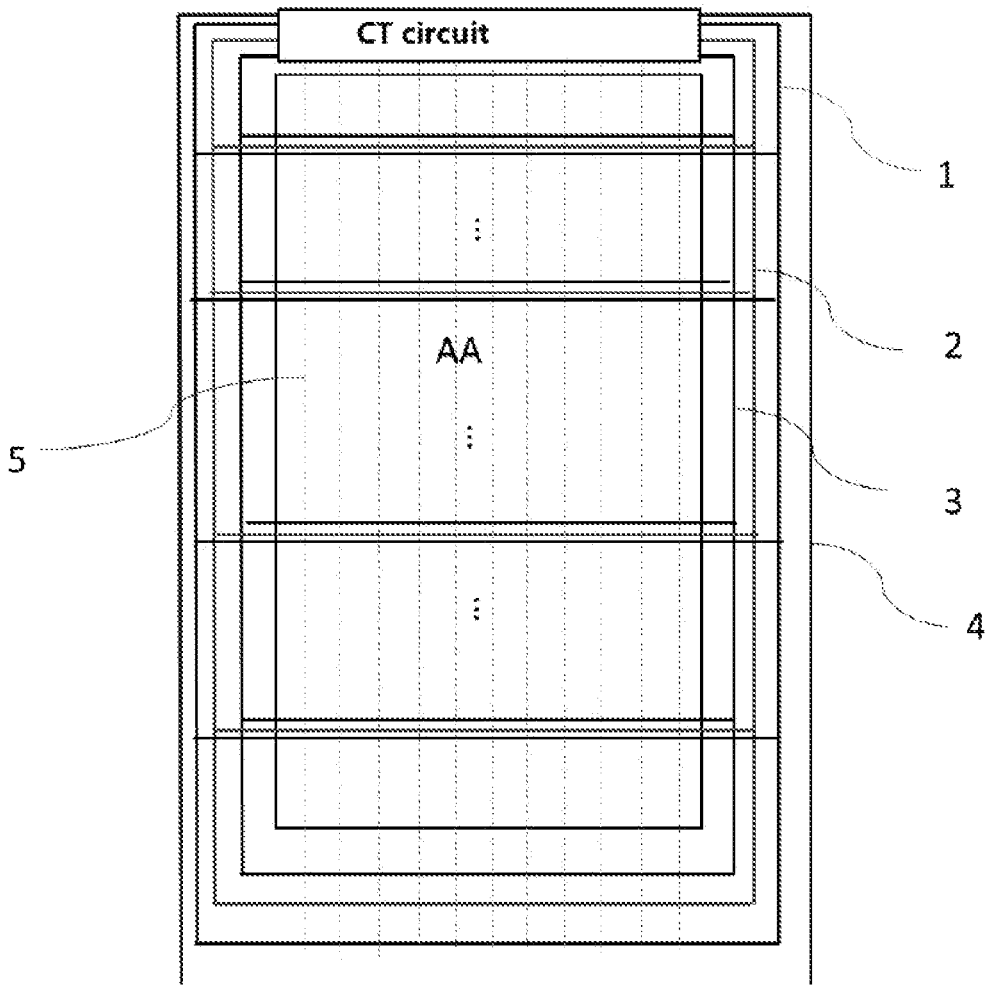

FIG. 5*a* is a diagram of a connecting type in a panel of the AMOLED panel cell testing circuit of the preferred embodiment of the application.

Figure 5B:
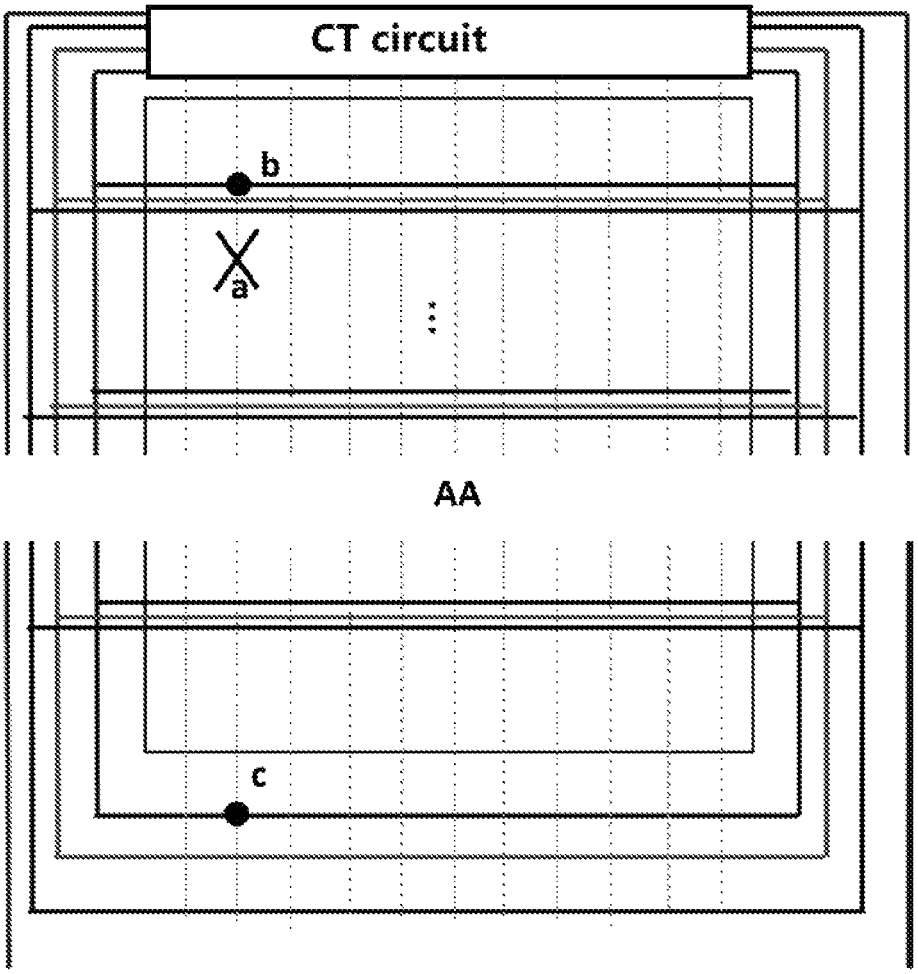

FIG. 5*b* is a failure circuit repair principle schematic diagram of the AMOLED panel cell testing circuit of the preferred embodiment of the application.

Figure 5C:
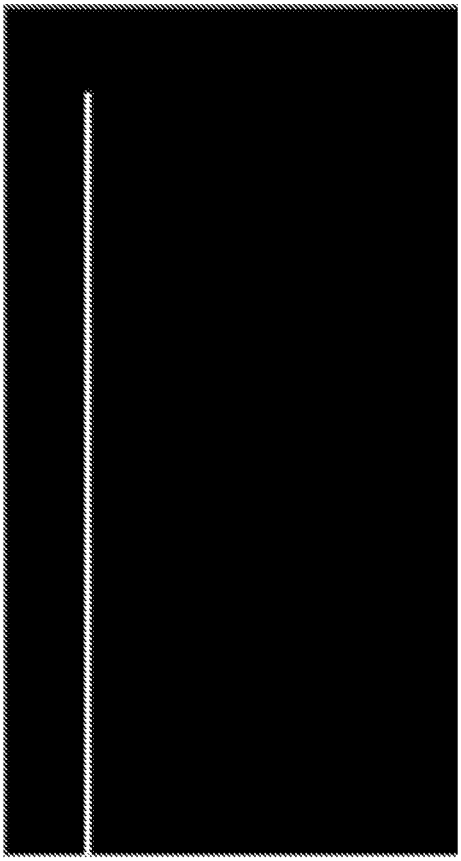

FIG. 5*c* is a display effect diagram of an abnormal screen of the AMOLED panel cell testing circuit of the preferred embodiment of the application testing a black screen.

Figure 5D:
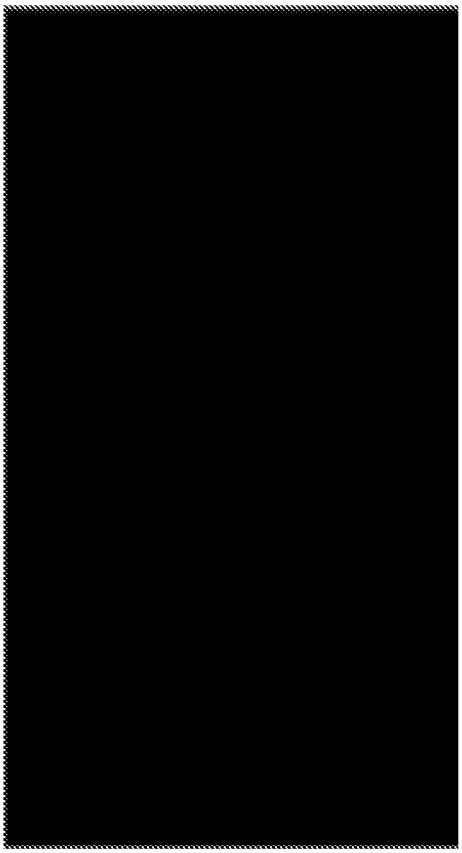

FIG. 5*d* is a display effect diagram of an abnormal screen of FIG. 5*c* after being repaired.

DETAILED DESCRIPTION OF PREFERRED EMBODIMENTS

Referring to FIG. 2*a*, FIG. 2*b*, and FIG. 2*a*, FIG. 2*a* is a schematic diagram of an AMOLED panel cell testing circuit of a preferred embodiment of the application, FIG. 2*b* is an equivalent circuit diagram of the preferred embodiment, FIG. 5*a* is a diagram of a connecting type in a panel of the preferred embodiment. Referring to FIG. 2*a*, the AMOLED panel cell testing circuit of the application includes:

A first switch SW1, wherein a control end of the first switch is connected to a detection control signal EN, a first data signal Data R/B is input into an input end of the first switch, an output end of the first switch is connected to a first detection data signal line CT R.

A second switch SW2, wherein a control end of the second switch is connected to a detection control signal EN, a second data signal Data B/R is input into an input end of the second switch, an output end of the second switch is connected to a second detection data signal line CT B.

A third switch SW3, wherein a control end of the third switch is connected to a detection control signal EN, a third data signal Data G is input into an input end of the third switch, an output end of the third switch is connected to a third detection data signal line CT G.

The detection control signal EN can be configured to control several switches to connect or disconnect, thereby to control the cell testing circuit to work or not. The first switch SW1, the second switch SW2, and the third switch SW3 can be thin film transistors, correspondingly control ends can be gate electrodes of the thin film transistors, and correspondingly input ends and output ends can be source electrodes or drain electrodes of the thin film transistors.

Data lines of a panel are divided into first kind of data lines, second kind of data lines, and third kind of data lines according to an arrangement mode of a connection to sub pixels. The first detection data signal line CT R is connected to the first kind of data lines, the second detection data signal line CT B is connected to the second kind of data lines, and the third detection data signal line CT G is connected to the third kind of data lines.

The kinds of the data lines has a relationship with an arranging type of the R/G/B of the pixel region, referring to FIG. 2*b*, in this embodiment, the arranging type of the R/G/B is that: in the first row, there is a RGBG periodic array, in the second row, there is a BGRG periodic array, in odd number rows, there are periodic arrays repeating the first row, and in even number rows, there are periodic arrays repeating the second row. In a vertically direction, sub pixels connected to the first kind of data line are arranged as R sub pixels and B sub pixel arranged alternately, sub pixels connected to the second kind of data line are arranged as R sub pixels and B sub pixel arranged alternately, and all of sub pixels connected to the third kind of data line are G sub pixel. In other embodiments, there can be an arranging type different from the R/G/B arranging type of FIG. 2*b*, and not repeated it here. There are three detection data signal lines, the first detection data signal line CT R is connected to the first kind of data line, the second detection data signal line CT B is connected to the second kind of data line, and the third detection data signal line CT G is connected to the third kind of data line. For the sub pixels arranged in the first row of the active display area of the panel, a red pixel circuit is input to the light emitting layer of the first row of the active display area via the first detection data signal line CT R, a blue pixel circuit is input to the light emitting layer of the first row of the active display area via the second detection data signal line CT B, and a green pixel circuit is input to the light emitting layer of the first row of the active display area via the first detection data signal line CT G. Deciding from the R/G/B arranging type of the preferred embodiment, according to a temporal variation, the first data signal Data R/B can be a detection data of a red sub pixel or a blue sub pixel, the second data signal Data B/R can be a detection data of a blue sub pixel or a red sub pixel, and the third data signal Data G can be a detection data of a green sub pixel.

Referring to FIG. 5*a*, the first detection data signal line CT R, the second detection data signal line CT B, and the third detection data signal line CT G comprise a first vertical line 1, a second vertical line 2, and a third vertical line 3 disposed correspondingly and placed in two sides of an active display area (AA) of the panel, and a plurality of first parallel lines, a plurality of second parallel lines, and a plurality of third parallel lines arranged by a default interval and being perpendicular to the data lines 5 are formed in the active display area of the panel and correspondingly connected to the first vertical line, the second vertical line, and the third vertical line placed in the two sides. When an open circuit does not occur in the data lines 5 of the panel, the first parallel lines, the second parallel lines, and the third parallel lines are not connected to the data lines 5. And, detection control signals 4 are formed in two sides of the active display area of the panel to transmit the detection control signal EN, and the detection control signal EN can be transmitted from a cell testing circuit pad. In the cell testing (CT) circuit of the application, the first detection data signal line CT R, the second detection data signal line CT B and the third detection data signal line CT G, there are three signal line, are formed across through the AA area from the lines arranged the two sides in an area adjacent to the AA area, but not connected to the AA area. When an open circuit occurs in a certain position of a certain data line 5 of the panel, one of the first parallel lines, the second parallel lines, and the third parallel lines is connected to the certain data line 5 to repair the open circuit in the certain position.

In a conventional AMOLED display device, a conventional CT circuit can be only used as a circuit used for testing panel display, however, in the application, the conventional circuit is modified, thereby to achieve a screen detecting function of the cell testing circuit, and when the data lines are disabled, the detection signal lines can be fused and conducted with the data lines of the panel by a laser welding process, a conventional line defect is modified, there is hardly any difference between a modified display effect and a display effect of a superior panel. This improvement design achieves to repair the circuit and to improve panel yield.

Referring to FIG. 3, FIG. 3 is a clock signal diagram of the AMOLED panel cell testing circuit of the preferred embodiment of the application displaying a red screen, when a red screen is displayed, a detection data Data R input into a red sub pixel of the active display area of the panel is a high level, correspondingly, a detection data Data B input into a blue sub pixel of the active display area of the panel is a low level. In the application, the first data signal Data R/B, the second data signal Data B/R, and the third data signal Data G can use a clock signal to achieve a solid color and color bar screen detection, and there is hardly any difference between the display effect and a display effect of a conventional CT circuit detection panel.

Referring to FIG. 4, FIG. 4 is a diagram of positions of a cell testing circuit and a pad of the AMOLED panel cell testing circuit of the preferred embodiment of the application. A main body of the cell testing circuit 100 is placed upon the active display area 101, and a fan out line 102 is used for connecting the data lines of the active display area 101 and lines binding between chips of a binding area 103. The cell testing circuit 100 is further connected with a cell testing pad 104. The cell testing pad 104 can be used to provide the first data signal Data R/B, the second data signal Data B/R, the third data signal Data G, the detection control signal EN, and so on to the cell testing circuit 100. The flexible printed circuit 105 can be used to connect a main board of an electrically equipment. In this embodiment, there are two cell testing pads 104 placed in two sides under the active display area 101.

According to the AMOLED panel cell testing circuit, the application further provides a method for repairing data lines via the AMOLED panel cell testing circuit, an innovation point of the application is a new CT circuit connecting type, thereby to achieve a screen detecting function of a cell testing circuit and achieve to repair the circuit. In a conventional AMOLED display device, a conventional CT circuit can be only used as a circuit used for testing panel display; however, in the application, the conventional circuit is modified, thereby to achieve a screen detecting function of the cell testing circuit, and to accurately determine several positions of open circuits, and when the data line is disabled, the first parallel line, the second parallel line, and the third parallel line can be fused and conducted with the data lines of the panel by a laser welding process, a conventional line defect is modified, there is hardly any difference between a modified display effect and display effect of a superior panel. This improvement design achieves to repair the circuit and to improve panel yield.

Referring to FIG. 5*b*, FIG. 5*b* is a failure circuit repair principle schematic diagram of the AMOLED panel cell testing circuit of the preferred embodiment of the application, and it can be understood with FIG. 5*a*, FIG. 5*c*, and FIG. 5*d*, FIG. 5*c* is a display effect diagram of an abnormal screen of the preferred embodiment of the application testing a black screen, FIG. 5*d* is a display effect diagram of an abnormal screen of FIG. 5*c* after being repaired. The method for repairing the data lines of the application includes:

A step 10 of detecting an open circuit in a certain position of a certain data line in the active display area of the panel via the cell testing circuit. When the CT circuit is detecting a black screen, if a certain data line of the AA area is disabled, such as an open circuit occurs in an a position of the data line, there is no data signal input to a line being vertical to the a position of the data line, a display screen of the panel is a vertical bright line.

A step 20 of selecting one selected position in each of two sides of the certain position of the certain data line, selecting one of the first parallel lines, the second parallel lines, and the third parallel lines correspondingly to the first detection data signal line CT R, the second detection data signal line CT B, and the third detection data signal line CT G to connect the certain data line at the selected positions to repair the open circuit in the certain position. A b position and a c position is selected from two sides of the a position of the data line, a laser welding process is employed to one parallel line of the CT circuit in the b position of FIG. 5*b* to make the data signals transmitted to the circuit of the AA area, there are two same signals transmitted to the data line in the vertical direction, an abnormal pixel without signals transmitted because of the open circuit is promoted to a normal pixel with data signals transmitted to the b position, and in order to make a normal output of a module stage, the laser welding process is employed to connect the data lines and the parallel line of a periphery of the CT circuit in the c position, thereby to make signals transmit to the parallel line of the CT circuit used as a repairing line.

Further, the method can include a step 21 of repeating the step 10 and the step 20 to repair all of the open circuits of the certain data line. By a detecting and repeating process of repeating the step 10 and the step 20 is employed to a certain data line, the application not only can achieve a screen detecting function of the CT circuit, but also accurately determine several positions of open circuits, thereby to repair all of the open circuits of the certain data line. Anyone of the first parallel lines, the second parallel lines, and the third parallel lines correspondingly to the first detection data signal line CT R, the second detection data signal line CT B, and the third detection data signal line CT G can be used to repair open circuits of different positions of one data line in the active display area to repair optional positions of one vertical data line.

Further, the method further includes a step 22 of repeating the step 21 to repair several open circuits of several data lines in the active display area. By a detecting and repeating process of repeating the step 21 is employed to the several data lines the active display area, the several data lines the active display area can be repaired. Because the CT circuit includes three kinds of the first parallel lines, the second parallel lines, and the third parallel lines correspondingly to the first detection data signal line CT R, the second detection data signal line CT B, and the third detection data signal line CT G, open circuits of three data lines of the active display area can be repaired, thereby to repair open circuit of three vertical data lines of the active display area, and for each data line, optional positions of the vertical data lines can be repaired.

A step 30 of disconnecting the first data signal Data R/B, the second data signal Data B/R and the third data signal Data G from the cell testing pads to the cell testing circuit in a module stage. In the module stage, a laser process is employed to cut signals of the several data signal lines from the CT pads to the CT circuit to avoid chips and the CT pads transmitting signals to CT circuit parallel lines used as repairing lines and to avoid chip failure. This improvement design of the application not only achieve not only can achieve a screen detecting function of the CT circuit, but also accurately determine several positions of open circuits, thereby to achieve a circuit repairing function and improve panel yield.

In a conventional AMOLED display device, a conventional CT circuit can be only used as a circuit used for testing panel display. If several open circuits occur in one data line of the panel (a screen displays a vertical bright line) and positions cannot be accurately determined, this design of the application can modified the conventional circuit to achieve a screen detecting function of the cell testing circuit, and to accurately determine several positions of open circuits and achieve to repair the circuit; and furthermore, when the data line is disabled, the parallel lines can be fused and conducted with the data lines of the panel by a laser welding process, a conventional line defect is modified, there is hardly any difference between a modified display effect and a display effect of a superior panel. This improvement design achieves to repair the circuit and to improve panel yield.

In the above, various other changes and modifications can be made in accordance with the technical solutions and technical concept of the present invention, and all such changes and modifications should be included in the scope of claims.

What is claimed is:

1. An active-matrix organic light emitting diode (AMOLED) panel cell testing circuit, comprising:

a first switch, wherein a control end of the first switch is connected to a detection control signal, a first data signal is input into an input end of the first switch, an output end of the first switch is connected to a first detection data signal line;

a second switch, wherein a control end of the second switch is connected to a detection control signal, a second data signal is input into an input end of the second switch, an output end of the second switch is connected to a second detection data signal line;

a third switch, wherein a control end of the third switch is connected to a detection control signal, a third data signal is input into an input end of the third switch, an output end of the third switch is connected to a third detection data signal line;

wherein data lines of a panel are divided into first kind of data lines, second kind of data lines, and third kind of data lines according to an arrangement mode of a connection to sub pixels, the first detection data signal line is connected to the first kind of data lines, the second detection data signal line is connected to the second kind of data lines, and the third detection data signal line is connected to the third kind of data lines;

wherein the first detection data signal line, the second detection data signal line, and the third detection data signal line comprise a first vertical line, a second vertical line, and a third vertical line disposed correspondingly and placed in two sides of an active display area of the panel, and a plurality of first parallel lines, a plurality of second parallel lines, and a plurality of third parallel lines arranged by a default interval and being perpendicular to the data lines are formed in the active display area of the panel and correspondingly connected to the first vertical line, the second vertical line, and the third vertical line placed in the two sides; and wherein when a cell testing process is employed, a color bar screen detection process is employed by the first data signal, the second data signal, and the third data signal via a clock signal.

2. The AMOLED panel cell testing circuit of claim 1, wherein the sub pixels connected to the first kind of data lines are arranged alternately by R sub pixels and B sub pixels; the sub pixels connected to the second kind of data lines are arranged alternately by B sub pixels and R sub pixels; and all of the sub pixels connected the third kind of data lines are G sub pixels.

3. The AMOLED panel cell testing circuit of claim 1, wherein the cell testing circuit further is connected to cell testing pads, the cell testing pads are configured to provide the first data signal, the second data signal, and the third data signal for the cell testing circuit.

4. The AMOLED panel cell testing circuit of claim 3, wherein there are two cell testing pads placed in two sides under the active display area.

5. The AMOLED panel cell testing circuit of claim 4, wherein a main body is placed upon the active display area.

6. The AMOLED panel cell testing circuit of claim 1, wherein when an open circuit does not occur in the data lines of the panel, the first parallel lines, the second parallel lines, and the third parallel lines are not connected to the data lines.

7. The AMOLED panel cell testing circuit of claim 1, wherein when an open circuit occurs in a certain position of a certain data line of the panel, one of the first parallel lines, the second parallel lines, and the third parallel lines is connected to the certain data line to repair the open circuit in the certain position.

8. A method for repairing the data lines via the AMOLED panel cell testing circuit of claim 1, comprising:

a step 10 of detecting an open circuit in a certain position of a certain data line in the active display area of the panel via the cell testing circuit;

a step 20 of selecting one selected position in each of two sides of the certain position of the certain data line, selecting one of the first parallel lines, the second parallel lines, and the third parallel lines to connect the certain data line at the selected positions to repair the open circuit in the certain position;

a step 30 of disconnecting the first data signal, the second data signal and the third data signal from the cell testing pads to the cell testing circuit in a module stage.

9. The method for repairing the signal lines of claim 8 further comprises a step 21 of repeating the step 10 and the step 20 to repair all of the open circuits of the certain data line.

10. The method for repairing the data lines of claim 9 further comprises a step 22 of repeating the step 21 to repair several open circuits of several data lines in the active display area.

11. The method for repairing the data lines of claim 8, wherein the first parallel line, the second parallel line, and the third parallel line are configured for repair the open circuits placed in three different data lines of the active display area of the panel respectively.

12. The method for repairing the data lines of claim 8, wherein one of the first parallel line, the second parallel line, and the third parallel line is configured for repair the open circuits placed in different positions of one of the data lines of the active display area of the panel.

* * * * *